US008770914B2

(12) United States Patent
Eppendorfer et al.

(10) Patent No.: US 8,770,914 B2
(45) Date of Patent: Jul. 8, 2014

(54) STEAM TURBINE SYSTEM AND METHOD FOR OPERATING A STEAM TURBINE

(75) Inventors: Jörg Eppendorfer, Görlitz (DE); Bernd Leidinger, Dresden (DE); Markus Mantei, Friedersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 834 days.

(21) Appl. No.: 13/054,228

(22) PCT Filed: Jul. 16, 2009

(86) PCT No.: PCT/EP2009/059152

§ 371 (c)(1),
(2), (4) Date: Apr. 5, 2011

(87) PCT Pub. No.: WO2010/007131

PCT Pub. Date: Jan. 21, 2010

(65) Prior Publication Data

US 2011/0185732 A1 Aug. 4, 2011

(30) Foreign Application Priority Data

Jul. 16, 2008 (DE) ..... 10 2008 033 402

(51) Int. Cl.

| | |
|---|---|
| ***F01K 13/02*** | (2006.01) |
| ***F01D 1/02*** | (2006.01) |
| ***F01D 25/12*** | (2006.01) |
| ***F01K 7/20*** | (2006.01) |

(52) U.S. Cl.

CPC ..... *F01D 1/023* (2013.01); *F01D 25/12* (2013.01); *F01K 7/20* (2013.01); *F05D 2260/2322* (2013.01); *F05D 2270/3032* (2013.01)

USPC ..... 415/1; 415/17; 415/22; 415/37; 415/145; 415/151; 415/176; 415/200; 416/241 A

(58) Field of Classification Search

CPC ..... F01D 1/023; F01D 25/12; F01K 7/20; F05D 2270/3032; F05D 2260/2322

USPC ..... 415/1, 17, 20, 22, 36, 37, 144, 145, 415/151, 175, 176, 200; 416/241 A

See application file for complete search history.

(56) References Cited

U.S. PATENT DOCUMENTS

| | | | | |
|---|---|---|---|---|
| 4,793,132 | A * | 12/1988 | Okabe | 60/39.182 |
| 5,490,386 | A * | 2/1996 | Keller et al. | 60/660 |
| 5,613,356 | A * | 3/1997 | Frutschi | 60/783 |
| 6,474,069 | B1 * | 11/2002 | Smith | 60/727 |
| 2002/0081191 | A1 * | 6/2002 | Tremmel et al. | 415/1 |

FOREIGN PATENT DOCUMENTS

| | | |
|---|---|---|
| AT | 247375 B | 6/1966 |
| DE | 4129518 A1 | 3/1993 |
| DE | 19823251 C1 | 7/1999 |
| DE | 10042317 A1 | 3/2002 |

(Continued)

*Primary Examiner* — Igor Kershteyn

(57) ABSTRACT

A steam turbine system including a steam turbine is provided. The steam turbine system includes a high-pressure side steam inlet device, a low-pressure side steam device, and a control device for controlling the steam turbine. An additional steam inlet device is also included arranged between the high-pressure side steam inlet device and the low-pressure side steam device. The control device control a supply of steam via the additional steam inlet device as a function of operating parameters detected at the steam turbine system.

17 Claims, 2 Drawing Sheets

(56) References Cited

FOREIGN PATENT DOCUMENTS

| | | | |
|---|---|---|---|
| EP | 0314028 | A1 | 5/1989 |
| EP | 0674099 | A1 | 9/1995 |
| EP | 1632650 | A1 | 3/2006 |
| EP | 1788197 | A1 | 5/2007 |
| WO | WO 0233226 | A1 | 4/2002 |
| WO | WO 2008104465 | A2 | 9/2008 |

* cited by examiner

STEAM TURBINE SYSTEM AND METHOD FOR OPERATING A STEAM TURBINE

CROSS REFERENCE TO RELATED APPLICATIONS

This application is the US National Stage of International Application No. PCT/EP2009/059152, filed Jul. 16, 2009 and claims the benefit thereof. The International Application claims the benefits of European Patent Office application No. 10 2008 033 402.2 EP filed Jul. 16, 2008. All of the applications are incorporated by reference herein in their entirety.

FIELD OF INVENTION

The invention relates to a steam turbine system and to a method for operating a steam turbine.

BACKGROUND OF INVENTION

In a steam turbine the thermal energy from steam supplied to the turbine is converted into mechanical work. Known steam turbines of this kind comprise a high-pressure side steam inlet and a low-pressure side steam outlet. A control device for controlling at least the steam inlet, but usually for controlling additional system components as well, is also provided. A shaft extending through the turbine, what is referred to as the turbine rotor, is driven with the aid of turbine vanes. Coupling the rotor to an electric generator makes a steam turbine system possible, for example the production of electrical energy.

Rotor vanes and guide vanes are typically provided for driving the rotor. The rotor vanes are secured to the rotor and rotate therewith, whereas the guide vanes are usually fixedly arranged on a turbine housing. Alternatively the guide vanes may, for example, be secured to what is known as guide vane carriers. The guide vanes ensure a good flow of steam through the turbine in order to achieve optimally efficient energy conversion. The temperature and the pressure of the steam are reduced in the route between steam inlet and steam outlet during this conversion.

In principle an optimally low pressure of the steam to be let out should be sought for reasons of efficiency. One problem associated with low outlet pressures, however, is what is known as impingement corrosion which leads to high wear of the rotor vanes.

Owing to the saturated steam state being attained in a low-pressure section of the turbine, moisture that has condensed out of the steam can precipitate and form water droplets in the turbine. Water droplets entrained by the flow of steam collide with the rotating rotor vanes with a high level of energy so the vanes are subject to corresponding wear.

As even hardened steel is removed as a result of this effect, high expenditure on manufacturing optimally resistant rotor vanes, for example by way of coatings made of special material, is the upshot in practice.

Apart from the high costs of specially-coated rotor vanes there is often the problem that these rotor vanes allow comparatively low maximum application temperatures, for example only up to about 120° C. While it is quite possible to design steam turbine systems in such a way that during normal operation corresponding maximum temperatures are not exceeded in a low-pressure section of the turbine, the no-load or low-load operation of the steam turbine, which is required at times in practice and at which the temperature is increased in the low-pressure section, for example to about 200 to 250° C. or more, due to the effect of what is referred to as ventilation, is a problem.

During ventilation the steam in the low-pressure section (for example end stage), which has already been extensively expanded and cooled in preceding turbine sections, is heated again by the rotating rotor vanes.

Apart from the fact that this kind of ventilation impairs the energy conversion efficiency in the low-load range, the elevated temperature prevents a plurality of materials being used to manufacture rotor vanes in the low-pressure section which would otherwise be preferred, for example owing to their high specific strength compared with steel. The use of fiber composite vanes (for example CFRP) or other lightweight vanes, whose basic vane material and/or optionally provided coating allows only a lower maximum temperature, should, for example, be considered in this connection.

SUMMARY OF INVENTION

It is the object of the present invention to solve such problems and in particular to avoid excess ventilation or a temperature increase in a low-pressure section of a steam turbine.

This object is achieved according to the invention by a steam turbine system as claimed in the claims and by an operating method as claimed in the claims. The dependent claims relate to advantageous developments of the steam turbine system. Most of these developments may be analogously used in the case of the inventive operating method as well.

The inventive steam turbine system is characterized in that the steam turbine comprises an additional steam inlet device arranged in the route between the steam inlet device and the steam outlet device, and in that the control device is designed to control a supply of steam via the additional steam inlet device as a function of operating parameters detected at the steam turbine system.

With the invention it is possible in certain operating situations to activate an additional steam inlet as an alternative or in addition to the high-pressure side steam inlet in order to therefore improve operation of the steam turbine. Excess ventilation in particular can be avoided with the invention, so the temperature stress of the relevant turbine components that has hitherto accompanied such ventilation is reduced. The service life of these components can advantageously under some circumstances therefore be extended. The present inventors have also found that a reduced temperature stress in the low-pressure section of the turbine advantageously makes it possible for the turbine vanes to have a lightweight construction, in particular for example by using a fiber composite material, such as CFRP. Materials of this kind have previously largely been considered unfeasible for manufacturing these turbine vanes.

In a preferred embodiment it is provided that a specially-conditioned steam is provided for supplying via the additional steam inlet device. This advantageously takes account of the fact that, viewed in the direction of the flow of steam in the turbine, both the temperature and the pressure of the steam is reduced. Depending on the specific arrangement of the additional steam inlet in the route of the turbine, the steam supplied there as required can be adjusted in terms of its temperature and/or its pressure. The values of the temperature and pressure of the steam supplied via the additional steam inlet device should usually be selected so as to be significantly lower than the corresponding values at the high-pressure side steam inlet but are preferably greater than the values which would result at this point in the route of the turbine without the additional steam inlet.

The steam turbine system may, for example, be an industrial steam turbine system in which the steam turbine is coupled to a generator for the production of electrical energy, the output of which is, for example, between 2 MW and 50 MW. However, the invention is also suitable for energy production in larger systems, for example for large-scale industrial systems with an output greater than 100 MW.

With respect to the problems solved by the invention the steam turbine system can in particular be a condensing steam turbine system in which the steam let out of the turbine at the low-pressure side is condensed and, for example, heated again in a circuit in order to generate the fresh steam that is to be let in at the high-pressure side.

To attain optimally high efficiency, turbines are usually divided into a plurality of turbine stages, one such stage consisting of a row of guide vanes and a row of adjacent rotor vanes downstream. The individual vanes of a row extend at a common axial height here, but in the circumferential direction are mutually angularly offset in different radial directions.

One or more stages provided at the high-pressure side (entry side) may be called the "high-pressure section", whereas one or more stages at the end of the turbine, i.e. at the low-pressure side (exit side) are conventionally called the "low-pressure section" or "end stage(s)" of the turbine.

Irrespective of this, all of the turbine stages arranged one behind the other may also be divided into groups in terms of construction or structure, which groups may each have a separate turbine housing ("drum") or be accommodated in a common turbine housing. In some constructions a high-pressure stage group, a medium-pressure stage group and a low-pressure stage group for instance could also be referred to.

The designational systematics of the turbines and general linguistic usage usually provide high-pressure stages and low-pressure stages in any case. These can each be, but do not have to be, arranged in a separate housing (which can be connected to the adjacent housing by a pipeline for example).

The additional steam inlet device provided according to the invention is particularly preferably arranged in a low-pressure section of the turbine, in particular at the entry to an "end stage". The exit of the final end stage can then be connected, for example directly, to a condenser for condensing the steam let out at the low-pressure side.

The invention is particularly interesting for steam turbines in which the pressure of the steam to be let out via the low-pressure side steam outlet device is smaller by a factor of at least $10^2$ than the pressure of the steam to be let in via the high-pressure side steam inlet device.

The steam to be let in at the high-pressure side can, for example, have a pressure of more than 10 bar, whereas the steam to be let out at the low-pressure side can have a pressure of less than 0.5 bar.

The steam supplied, if required, via the additional steam inlet device preferably has a pressure and a temperature that are each between the corresponding values of the high-pressure side steam inlet and the low-pressure side steam outlet, the pressure and/or the temperature of the steam supplied via the additional steam inlet device preferably being considerably greater than the values to be expected at this location of the turbine for the same operating state of the turbine without such an additional steam inlet. Ventilation downstream of the additional steam inlet may reliably be avoided therefore.

The additional steam inlet device preferably arranged at the entry to a low-pressure section of the steam turbine preferably comprises a controllable valve with which the supply of steam may be controlled as required. Use of a proportional valve, by means of which the flow of steam may be exactly adjusted to a desired extent, is particularly preferred at this location.

According to one embodiment it is provided that when low-load operation of the steam turbine is detected the supply of steam is effected via the additional steam inlet device. Low-load operation can, for example, be detected with the aid of an evaluation of a torque instantaneously supplied by the turbine or an instantaneously supplied rotational power (for example at a coupling of the turbine rotor).

Alternatively or additionally it may be provided that when a certain temperature increase is detected in a low-pressure section of the steam turbine the supply of steam is effected via the additional steam inlet device. Such a temperature increase may in the simplest case be defined as a predetermined temperature threshold being exceeded. Alternatively or additionally the temperature increase may also be detected by taking account of an instantaneous temperature change rate.

In one embodiment it is provided that the supply of steam via the high-pressure side steam inlet device is also controlled as a function of the detected operating parameters. The high-pressure side steam inlet device can comprise a valve, for example a proportional valve, for this purpose.

In a simple embodiment of the invention it may be provided that when low-load operation is detected and/or when a predetermined temperature increase is exceeded a valve of the high-pressure side steam inlet device is closed and instead a valve of the additional steam inlet device is opened. This represents a "special operating mode" by means of which an increase in temperature owing to ventilation in a low-pressure section of the turbine can advantageously be counteracted.

With appropriate construction and activation the two said valves can be continuously adjusted. In said special operating mode the valve of the additional steam inlet device, for example, can then be opened to a greater or lesser extent, according to requirements, the valve of the high-pressure side steam inlet device preferably being correspondingly closed to a greater or lesser extent. In other words, there is no need for sudden adjustment of the supply of steam. What is essential is an additional supply of steam triggered as a function of instantaneously detected operating parameters during which the high-pressure side supply of steam may optionally also be changed (reduced).

In practice it is usually advantageous if the high-pressure side steam inlet is not completely closed even in the case of considerable supply of steam via the additional steam inlet device, and instead, for example, at least what is known as the "cooling steam volume" is conveyed through the high-pressure side section of the turbine. Otherwise there is the risk that the turbine rotors driven by the steam supply in the low-pressure section will lead to ventilation in the high-pressure section of the turbine.

In one embodiment it is provided that the detected operating parameters include a torque measured at a turbine rotor.

In one embodiment it is provided that the detected operating parameters include a temperature measured in a low-pressure section of the steam turbine.

Alternatively or additionally, further operating parameters of the system, in particular of the turbine, may be measured, such as a rotational speed or speed of the turbine rotor. An instantaneous rotational power of the turbine rotor for example may be derived from the detected torque and detected speed of the rotor.

In one embodiment it is provided that a special operating mode with a controlled supply of steam via the additional steam inlet device is activated when certain activation criteria exist, and this mode is deactivated when certain deactivation criteria exist. Corresponding criteria for activation of the operating mode have already been described above. A temperature and/or an increase in temperature in a low-pressure section of the turbine is/are of particular interest in this regard. In addition detection of low-load operation of the steam turbine for example is suitable because such low-load operation leads to the fear of an imminent temperature increase in the low-pressure section via the effect of ventilation.

The presence of activation criteria and deactivation criteria can be checked for example by means of suitable software or by means of an electronically stored look-up table.

The criteria with the aid of which activation and deactivation of the special operating mode ("additional steam inlet") is triggered and/or other criteria may then be continuously checked during the special operating mode in order to control or regulate the turbine and/or other system components in the special operating mode.

As already described above, a special operating mode may be activated when certain activation criteria exist, in particular when low-load operation of the steam turbine is detected, in which mode there is an additional controlled supply of steam. According to a development an increase in the mechanical power consumption of the system components driven by the turbine is also effected in this operating mode. Apart from triggering an increased power consumption of the power consumers that are present anyway (for example electric generator) the "activation" of power consumers specifically provided for this purpose also comes into consideration in this connection. In other words, an additional power consumer for example may be integrated in the piping which receives power during no-load operation and converts it into heat, for example, which is dissipated. Ventilation in the end stages is also reduced as a result. Power from an electric generator coupled to the turbine may also be converted into heat via heating resistors.

The additional power provided by increasing the mechanical power consumption can, for example, be used to heat the medium (for example water) supplied to the turbine at the input side and/or via the additional steam inlet device. In particular this power may be used to pre-heat the condensate in a circuit of a system constructed as a condensation steam turbine system.

In one embodiment of the invention a water injection in an exit region of the turbine is also activated as a function of operation parameters detected at the steam turbine system, and this can advantageously provide an additional cooling effect.

In one embodiment it is provided that safety monitoring with regard to a temperature measured in a low-pressure section of the steam turbine takes place in the above-described special operating mode in which a controlled supply of steam takes place via the additional steam inlet device, and the turbine is switched off when predetermined danger criteria are fulfilled (for example excess temperature and/or excess temperature increase tendency).

In one embodiment it is provided that at least some of the components in a low-pressure section of the turbine, in particular rotor vanes and/or guide vanes, are produced in a lightweight design, for example by using a fiber composite material (for example CFRP).

BRIEF DESCRIPTION OF THE DRAWINGS

The invention will be described in more detail hereinafter with the aid of exemplary embodiments and with reference to the accompanying drawings, in which.

DETAILED DESCRIPTION OF INVENTION

Figure 1:
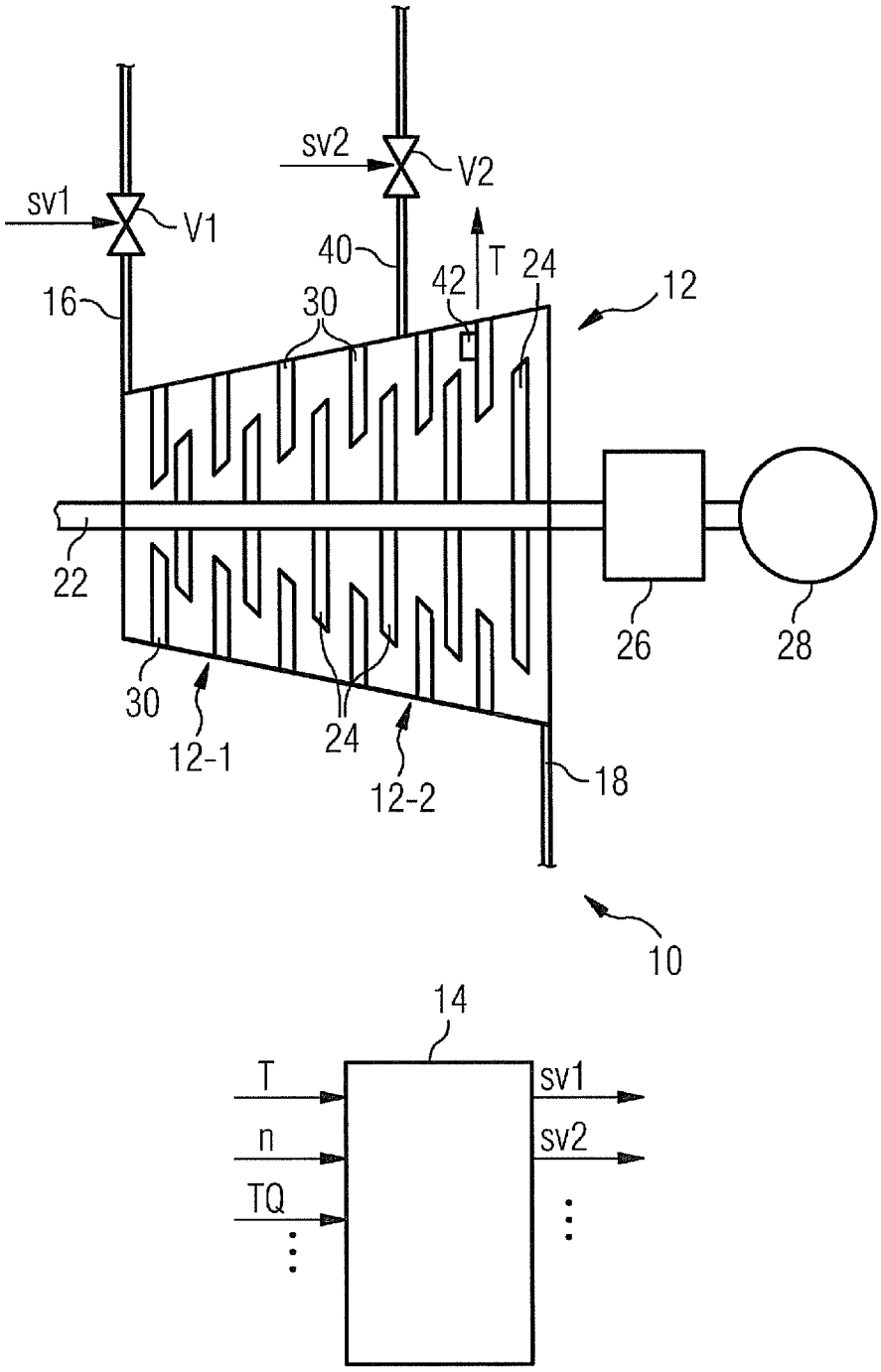
FIG. 1 shows a schematic diagram of essential components of a steam turbine system.

FIG. 1 shows a steam turbine system 10 having a steam turbine 10 and a control device 14 for controlling the steam turbine 12.

The turbine 12 comprises a high-pressure side steam feed pipe 16 for supplying fresh steam via a controllable valve V1 and a low-pressure side steam delivery pipe 18 which in the illustrated exemplary embodiment leads to a condenser (not shown) of a steam circuit from which fresh steam is produced again after the condensate has been heated.

During normal operation of the system 10 fresh steam, for example at a pressure of about $10^2$ bar and a temperature of about 500° C., is supplied via the feed pipe 16 at the entry to the turbine 12. In a middle region of the turbine 12 the steam has a significantly reduced pressure and a significantly reduced temperature for example about $10^1$ bar and about 200° C.) owing to preceding expansion. At a later stage the steam expands further and leaves at the exit of the turbine 12 again via the delivery pipe 18 at about $10^{-1}$ bar and about 40° C. (for example 0.05 bar and 33° C.).

The thermal energy of the steam supplied to the turbine 12 is converted into mechanical turning work in a manner known per se. A turbine rotor 22 that extends through the turbine 12 is driven by rotor vanes 24 secured thereto and in turn drives an electric generator 28 via an optionally provided gear 26. In contrast to the illustrated example the turbine could alternatively or additionally drive, for example, pumps, compressors or other units. Powerful pumps and/or compressors are often required, for example, to implement large-scale industrial chemical processes.

Viewed in the axial direction the rotor vanes 24 alternate with guide vanes 30 within the turbine 12 and this ensures a good flow of steam through the turbine. The guide vanes 30 are secured to the inside of the turbine housing and project radially inwardly therefrom.

As may be seen from FIG. 1, in the illustrated exemplary embodiment the turbine 12 comprises a total of six pairs of vane rows 30, 24.

An optimally low end pressure of the steam issuing at low-pressure side (after the last pair of vanes 30, 24) via the delivery pipe 18 is advantageous with regard to optimal efficiency in converting the thermal energy into mechanical work and ultimately electrical energy.

Previously however the serious problem of impingement corrosion has accompanied a low end pressure and this leads to high wear of the rotor vanes in the low-pressure section of the turbine. In the illustrated example the rotor vanes 24 of the turbine 12 that are arranged further to the right in FIG. 1 would therefore be affected by this. These form part of a first expansion section or low-pressure stage group 12-2, whereas the vanes located on the left in FIG. 1 are to be assigned to a second expansion section or a high-pressure stage group 12-1.

The use of optimally erosion-resistant rotor vanes 24 in the low-pressure section 12-2 or corresponding rotor vane coatings fails in practice however due the fact that corresponding materials often have comparatively low admissible maximum temperatures which may easily be exceeded in the turbine. This is exacerbated by the fact that in a steam turbine of the type illustrated operating situations exist such as in particular low-load operation or no-load operation in which the thermal energy of the supplied fresh steam is to a large extent already converted by the high-pressure section of the turbine and the steam flowing through the low-pressure section of the turbine is heated again by the effect of what is known as ventilation. Turbine vanes in the low-pressure section of known turbines are therefore conventionally manufactured from steel or titanium for example.

With ventilation in the low-pressure stage group 12-2 some of the rotational energy of the rotor 22 would be converted back into thermal energy of the steam by means of the rotating rotor vanes 24. In practice a rotor vane temperature that is about 40° C. during normal operation could easily be inflated to about 200 to 250° C. or more by this effect.

In the illustrated system 10 these problems are eliminated in the manner described below, however, so, for example, the rotor vanes 24 of the low-pressure stage group 12-2 may very advantageously be constructed as lightweight vanes, optionally with a special coating.

Essential to this is an additional steam inlet device (additional steam feed pipe 40 with controllable valve V2) arranged in the route between the steam feed pipe 16 and the steam delivery pipe 18, in the illustrated exemplary embodiment at the entry to the low-pressure stage group 12-2, a supply of steam via this additional steam inlet device 40, V2 being controlled by the control device 14 as a function of detected (in particular for example at the turbine) operating parameters.

A plurality of measured variables are input into the control device 14 for this purpose, such as a temperature T which is detected by means of a temperature sensor 42 arranged in the low-pressure stage 12-2, a speed n and a torque TQ which are detected by a sensor system (not shown), for example in the region of the gear 26.

By means of evaluation of the supplied operating parameters T, n, TQ, . . . the control device 14 generates a plurality of output signals for activating various system components. The continuously controllable valves V1 and V2 at the steam feed pipes 16 and 40 for example are activated by control signals sv1 and sv2.

During normal operation, for instance under full load, valve V1 is open and valve V2 is closed.

With the aid of the detected operating parameters the control device 14 recognizes an excessive temperature increase in the region of the end stage 12-2 and low-load operation which leads to the risk of such a temperature increase due to the effect of ventilation. In such a case the control device 14 counteracts an increase in temperature by way of a special operating mode in which specially conditioned steam is let in via the additional steam feed pipe 40. The relatively low output of the turbine 12 is therefore for the most part or even substantially only generated by means of the low-pressure section of the turbine 12 that follows the feed pipe 40. Due to power generation downstream of the feed pipe 40 ventilation is advantageously avoided in this region and the temperature remains low (or is reduced). In this special operating mode the flow of steam supplied at the high-pressure side, and therefore the power generation in the high-pressure stage 12-1, is switched off or reduced by simultaneous closing or substantial closing of valve V1.

The effect achieved according to the invention can, for example, be bolstered further by an additional injection of water in the region of the end stage 12-2, in particular in what is known as an exhaust steam housing of the end stage 12-2. Such a water injection that has a cooling effect can be effected, for example in said special operating mode, by the control device 14 and (quantitatively) controlled, preferably as a function of operating parameters which are detected at the turbine during this operating mode.

Figure 2:
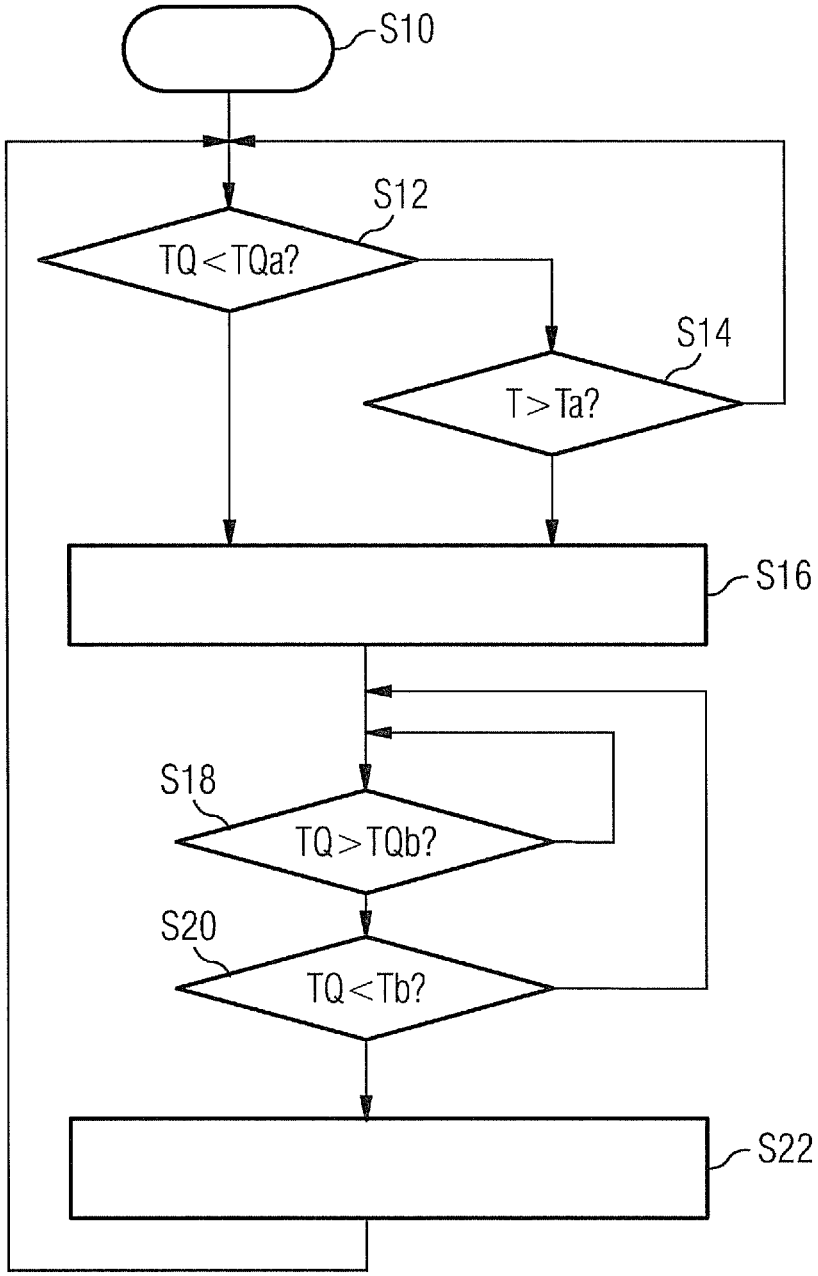
FIG. 2 shows a flow chart of an operating method that can be used in the turbine system of FIG. 1.

FIG. 2 is a flow chart to illustrate the turbine control effected by the control device 14 and which may be implemented for example by means of software running in the control device 14.

Processing begins in step S10.

It is checked in a step S12 whether a torque (for example a coupling moment) TQ is smaller than a predetermined threshold TQa.

If this is not the case it is checked in a step S14 whether the temperature T measured in end stage 12-2 is greater than a predetermined threshold Ta.

If this is not the case either processing returns to step S12.

If, however, the torque TQ is comparatively small (step S12) or the temperature T is relatively high (step S14), processing moves to step S16 in which valve V1 is closed and valve V2 is opened. The "special operating mode" is therefore activated and counteracts the increase in temperature in the end stage of the turbine 12.

In the illustrated exemplary embodiment this special operating mode is only deactivated again if both the torque TQ is greater than a predetermined threshold TQb (step S18) and the temperature T is lower than a predetermined threshold Tb (step S20). Only if the result of both queries is positive does processing move to a step S22 in which the special operating mode is deactivated again by opening valve V1 and closing valve V2 again. Processing then returns to step S12.

The thresholds TQb and Tb used for deactivation can match the corresponding thresholds for activation, i.e. TQb=TQa and Tb=Ta can apply. A hysteresis is alternatively and preferably provided however with respect to at least one type of threshold (for torque or temperature). In a preferred embodiment TQb is, for example, greater than TQa by a predetermined hysteresis value and Tb is less than Ta by a predetermined hysteresis value.

It is understood that in contrast to these activation and deactivation criteria other operating parameters detected by the control device 14 may also be used in practice.

The "special operating mode", which in the simplest case is a changeover of the supply of steam from the high-pressure side supply via the pipe 16 to intermediate supply via the pipe 40, may in practice also be adapted in many ways to the respective requirements. In particular it is possible to provide activation that is carried out as a function of the detected operating parameters, in particular continuous activation of valves V1 and/or V2, during the special operating mode. The possibility, in particular on the basis of the measured temperature T, of controlling the system 10 with the aim of keeping this temperature T within a certain range or below a certain maximum temperature is mentioned merely by way of example in this regard. Temperature regulation for example may be provided for this purpose. Such temperature regulation can consist for example of proportional, integral and differential fractions and optionally comprise pre-control as a function of the torque or rotational power.

In the special operating mode the turbine 12 can, for example, be operated in a speed-controlled or power-controlled manner or may be dependent on certain parameters of the driven system components (for example generator 28).

For a guaranteed decrease in minimum power in the special operating mode it may be provided that mechanical energy is converted into thermal energy, as long as insufficient power is consumed by the system components that are driven as normal, in order to avoid ventilation in the low-pressure section. This can take place for example via heating resistors that are fed via separate windings or via a special circuit of the existing windings of an electric generator.

The invention may be combined with further temperature-lowering measures. By way of example, an injection of water may be activated by the control device during the special operating mode in order to attain an additional cooling effect.

The effect of the inventive measures should be monitored, for instance to allow the turbine to be turned off quickly in critical operating situations.

To summarize, the design of the turbine 12 and its activation advantageously allow a reduction or total elimination of ventilation during low load or no-load operation, whereby the temperature increase that occurs during such an operating state can advantageously be avoided in the low-pressure section.

As the final stage of a condensing steam turbine is usually a limiting component with respect to maximum flow area or maximum speed of the turbine (centrifugal forces lead to high mechanical stresses of the rotating components) the use of lightweight vanes made possible by the invention, in particular of fiber composite vanes, is particularly advantageous due to the considerably lower weight with this type of turbine.

In one embodiment of the invention it is therefore provided that at least some of the rotor vanes in the low-pressure section of the turbine are produced in a lightweight design, in particular from fiber composite material (for example CFRP), optionally with a coating (to increase resistance to impingement erosion). A coating of this kind is in practice required for many fiber composite materials as these materials have lower impingement resistance compared, for example, to hardened steel.

The use of lightweight vanes with appropriate erosion protection systems is often only made possible at all due to the reduction attained with the invention in the maximum temperature that occurs at the end stage vanes. Advantageous possibilities result for using basic vane materials with a lower admissible maximum temperature, for example synthetic resin when using fiber-reinforced plastics material.

The invention claimed is:

1. A steam turbine system including a steam turbine, comprising:

a high-pressure side steam inlet device;

a low-pressure side steam outlet device;

a control device for controlling the steam turbine;

an additional steam inlet device, arranged between the high-pressure side steam inlet device and the low-pressure side steam outlet device, wherein the control device is designed to control a supply of steam for power generation via the additional steam inlet device as a function of operating parameters detected at the steam turbine system, wherein the detected operating parameters include a temperature measure in a low-pressure section of the steam turbine, and wherein the control device is configured to effect a supply of steam for power generation via the additional steam inlet device when a certain temperature increase is detected in the low-pressure section of the steam turbine.

2. The steam turbine system as claimed in claim 1, wherein conditioned steam is provided for supply via the additional steam inlet device.

3. The steam turbine system as claimed in claim 1, wherein the supply of steam is effected via the additional steam inlet device when a low-load operation of the steam turbine is detected.

4. The steam turbine system as claimed in claim 1, wherein the supply of steam is also controlled via the high-pressure side steam inlet device as a function of the operating parameters detected at the steam turbine system.

5. The steam turbine system as claimed in claim 1, wherein the detected operating parameters furs per include a torque measured at a turbine rotor.

6. The steam turbine system as claimed in claim 1, wherein a special operating mode with a controlled supply of steam is activated via the additional steam inlet device when a first set of activation criteria exist, and is deactivated again when a second set of deactivation criteria exist.

7. The steam turbine system as claimed in claim 6, wherein the special operating mode is activated when a low-load operation of the steam turbine is detected, in which mode a controlled supply of steam takes place via the additional steam inlet device and an increase in the mechanical power consumption of the system components driven by the steam turbine is effected.

8. The steam turbine system as claimed in claim 7, wherein the increase in the mechanical power consumption of the system components driven by the steam turbine is used to pre-heat a condensate in a circuit of the system constructed as a condensing steam turbine system.

9. The steam turbine system as claimed in claim 1, wherein an injection of water in an exit region of the steam turbine is also activated as a function of the operating parameters detected at the steam turbine system.

10. The steam turbine system as claimed in claim 1, wherein in a special operating mode in which a controlled supply of steam takes place via the additional steam inlet device, safety monitoring with regard to a temperature measured in a low-pressure section of the steam turbine takes place and the steam turbine is switched off when predetermined danger criteria are fulfilled.

11. The steam turbine system as claimed in claim 1, wherein at least some of a plurality of rotor vanes and/or a plurality of guide vanes in a low-pressure section of the steam turbine are produced in a lightweight design.

12. The steam turbine system as claimed in claim 11, wherein the lightweight design comprises a fiber composite material.

13. A method for operating a steam turbine, comprising:

providing a high-pressure side steam inlet device, a low-pressure side steam inlet device and an additional steam inlet device;

arranging the additional steam inlet device between the high-pressure side steam inlet device and the low-pressure side steam inlet device; and controlling a supply of steam for power generation via the additional steam inlet device as a function of detected operating parameters, wherein the detected operating parameters include a temperature measure in a low-pressure section of the steam turbine, and wherein the supply of steam for power generation is effected via the additional steam inlet device when a certain temperature increase is detected in the low-pressure section of the steam turbine.

14. The method as claimed in claim 13, wherein conditioned steam is provided for supply via the additional steam inlet device.

15. The method as claimed in claim 13, wherein the supply of steam is effected via the additional steam inlet device when a low-load operation of the steam turbine is detected.

16. The method as claimed in claim 13, wherein the supply of steam is also controlled via the high-pressure side steam inlet device as a function of operating parameters detected at the steam turbine.

17. The method as claimed in claim 13, wherein the detected operating parameters further include a torque measured at a turbine rotor.

* * * * *